US009534441B2

(12) United States Patent
Allen

(10) Patent No.: US 9,534,441 B2
(45) Date of Patent: Jan. 3, 2017

(54) INTERLOCKING ROLLING SHEET DOOR SYSTEM

(71) Applicant: DBCI, Douglasville, GA (US)

(72) Inventor: LaBraylon Allen, Rockmart, GA (US)

(73) Assignee: DBCI, Douglasville, GA (US)

( * ) Notice: Subject to any disclaimer, the term of this patent is extended or adjusted under 35 U.S.C. 154(b) by 0 days.

(21) Appl. No.: 14/590,759

(22) Filed: Jan. 6, 2015

(65) Prior Publication Data

US 2015/0191969 A1 Jul. 9, 2015

Related U.S. Application Data

(60) Provisional application No. 61/923,990, filed on Jan. 6, 2014.

(51) Int. Cl.
*E06B 9/17* (2006.01)
*E05D 1/04* (2006.01)
(Continued)

(52) U.S. Cl.
CPC . *E06B 9/17* (2013.01); *E05D 1/04* (2013.01); *E06B 9/0638* (2013.01); *E06B 9/15* (2013.01);
(Continued)

(58) Field of Classification Search
CPC ..... E06B 3/486; E06B 9/15; E06B 9/17; E06B 9/18; E06B 9/56; E06B 2009/1505; E06B 2009/1544; E05D 1/04
(Continued)

(56) References Cited

U.S. PATENT DOCUMENTS 1,872,652 A 8/1932 Best
4,630,664 A * 12/1986 Magro ..... E06B 9/15 160/232
(Continued)

FOREIGN PATENT DOCUMENTS

BE 531000 A 8/1954
DE 9416687 U1 12/1994

OTHER PUBLICATIONS

International Search Report and Written Opinion for related PCT application PCT/US2015/010336 dated Apr. 1, 2015.

*Primary Examiner* — Katherine Mitchell
*Assistant Examiner* — Scott Denion
(74) *Attorney, Agent, or Firm* — Bracewell LLP; Brad Y. Chin

(57) ABSTRACT

In accordance with various embodiments, there is provided an interlocking rolling sheet door and a method for assembling the interlocking rolling sheet door. In accordance with at least one embodiment, the interlocking rolling sheet door includes at least one curtain panel. Each curtain panel includes a first curl on a lateral end and a second curl on an opposing lateral end. One of the first curl and the second curl is an interior curl portion, and the other of the first curl and the second curl is an exterior curl portion. The first curl of one curtain panel is configured to rotationally engage an inner portion of the second curl of an adjacent curtain panel, whereby the first curl rotationally engaging the second curl until a distal end of the first curl fouls out against an inner surface of the second curl. The first curl and the second curl are configured to rotationally engage one another to form an interlocking mechanism between adjacent curtain panels to form the interlocking rolling sheet door.

3 Claims, 8 Drawing Sheets

(51) Int. Cl.

| | |
|---|---|
| ***E06B 9/15*** | (2006.01) |
| ***E06B 9/18*** | (2006.01) |
| ***E06B 9/56*** | (2006.01) |
| ***E06B 9/06*** | (2006.01) |
| *E06B 3/48* | (2006.01) |
| *E06B 9/13* | (2006.01) |
| *E05D 1/06* | (2006.01) |

(52) U.S. Cl.
CPC . *E06B 9/18* (2013.01); *E06B 9/56* (2013.01); *E05D 1/06* (2013.01); *E05Y 2900/00* (2013.01); *E05Y 2900/106* (2013.01); *E06B 3/486* (2013.01); *E06B 9/13* (2013.01); *E06B 2009/1505* (2013.01); *E06B 2009/1544* (2013.01)

(58) Field of Classification Search
USPC ..... 160/235
See application file for complete search history.

(56) References Cited

U.S. PATENT DOCUMENTS

| | | | | |
|---|---|---|---|---|
| 4,972,894 | A * | 11/1990 | Machill | E06B 9/15 160/235 |
| 2005/0205223 | A1* | 9/2005 | Miller | E06B 9/15 160/236 |
| 2013/0048231 | A1* | 2/2013 | Miller | E06B 9/15 160/133 |

* cited by examiner

INTERLOCKING ROLLING SHEET DOOR SYSTEM

RELATED APPLICATION

This application relates to, claims priority to and the benefit of, and incorporates by reference herein in its entirety U.S. Provisional Patent Application Ser. No. 61/923,990, titled, "INTERLOCKING ROLLING SHEET DOOR SYSTEM," filed on Jan. 6, 2014.

BACKGROUND

Field of the Invention

Embodiments of the invention relate to a rolling sheet door system. More particularly, embodiments of the invention relate to an interlocking rolling sheet door system that forms a continuous curtain of corrugated panels, which can be assembled and disassembled by rolling the corrugated panels together and apart.

Description of the Related Art

Sheet door manufacturers currently manufacture rolling sheet doors in accordance with the American National Standards Institute/Door and Access Systems Manufacturers Association Standard 207 (ANSI/DASMA 207). In accordance with ANSI/DASMA 207, a "rolling sheet door" is a vertically operating, coiling door typically used in commercial, industrial, or self-storage applications with a curtain consisting of formed metal sheets seamed together.

ANSI/DASMA 207 defines a "curtain" as an assembly of curtain panels seamed together. A "curtain panel" is defined as a formed metal sheeting consisting of multiple corrugations with horizontal hems. A "hem" is defined as interlocking "hooks" on the top and bottom edge of the curtain panel used to create a seam. A "seam" is defined as a method for permanently interlocking two consecutive curtain panel hems for creating a continuous sheet door curtain.

A conventional rolling sheet door is shown in FIGS. 1(*a*), 1(*b*), and 1(*c*). As shown in FIG. 1(*a*), the conventional rolling sheet door 100 includes one or more curtain panels 110 and a hem 120 formed on each end of each curtain panel 110. As shown in FIG. 1(*b*), a joint 130 is formed between two consecutive engaging curtain panel hems 120. FIG. 1(*c*) shows a seamed joint 130 interlocking the two consecutive curtain panel hems 120 of the conventional rolling sheet door 100.

Current sheet door manufacturers use a "hem and seam"-type panel, also known as a "positive lock"-type panel, to assemble a curtain of interlockable curtain panels. One conventional process includes roll forming an upward hem and a downward hem, as shown in FIGS. 1(*a*), 1(*b*), and 1(*c*), overlapping the opposing hems 120, and then rolling an industrial style press over the two hems 120 to form a seamed joint 130, interlocking the two hems 120 together. This process has proven to be a trustworthy method and has been used in the sheet door industry for over 25 years to create interlocking rolling sheet doors.

Conventional rolling sheet doors formed using this process, however, are difficult to disassemble and maintenance in the field. Because the hems are seamed together, it is difficult to remove or replace a curtain panel, which may be damaged, without causing severe damage to both the astatic and structural stability of the rolling sheet door, thus making conventional rolling sheet doors of this type a "disposable door".

For example, a curtain panel may be removed in the field by cutting the panel with a shear, snips, or a circular saw with the proper blade. The disadvantages of this process become apparent when trying to remove a curtain panel for repair, or add a new curtain panel. The new curtain panel would typically be attached by overlapping at least one rib of the corrugated curtain panel, and then using some type of fastener, such as a rivet or screw, to hold the curtain panels together. This process is not desirable when "curb appeal" is an area of concern. Overlapping the two curtain panels also adds weight to the door, which will have an adverse effect on the spring assembly, while also compromising the performance of the conventional rolling sheet door during, for example, a high wind event because of the added rigidity where the curtain panels overlap.

The curtain panel may also be removed in the field by manually opening the seam using a hammer, a flat head screw driver, a pry bar, or other tool to pry the two interlocked curtain panels apart. Once a portion of the hem is open, the claw end of the hammer or the pry bar is vigorously pulled across the door to open the rest of the seam. Due to the inconsistencies of pressure while pulling the tool across the door, such an action often results in the formation of ripples in the hems or other types of deformation. This process is not desirable when trying to add a new curtain panel. It is impossible to replicate the act of seaming in the field. In most cases, an operator attempts to seam the curtain panels using a hammer and "anvil" (e.g., another hammer, block of wood, heavy angle, etc.), and striking the hem across the length of the door. As a result, dents across the length of the door are routinely created. Forming a seam in the field between two interlocking hems is difficult because of the challenge in providing the proper amount of force or accuracy to form the seal. The major concern with both of these procedures is the effect they will have on rolling sheet door performance in certain conditions, such as high wind or impact resistance.

Another conventional rolling sheet door system includes a rolling steel or slat door, as shown in FIGS. 2(*a*), 2(*b*), and 2(*c*) (the "rolling slat door"). The rolling slat door is an overhead-coiling door having three basic components: a barrel assembly, guides, and a curtain. ANSI/DASMA 203-2004 defines a "barrel assembly" as a cylindrical horizontal member at the head of an opening that supports a door curtain and contains a counterbalance assembly. "Guides" are defined as a vertical assembly in which the door curtain travels and that is fastened to a jamb, retaining the edges of the door curtain and closing a space between a coil and a lintel. A "curtain" is defined as interlocked slats assembled together. ANSI/DASMA 203-2004 states that curtain slats shall interlock to allow the full range of angular rotation required to wrap the door curtain around the barrel assembly without binding or separation (i.e., the slats will not rotationally disengage). Due to the fact that the slats have to hinge or rotate around the barrel assembly (i.e., the hinge connecting adjacent slats is positioned on an interior side of the curtain door), the slats are limited to how they are assembled and disassembled. This limitation makes it difficult to repair the door curtain of slats in the field due to the amount of space needed to laterally slide slats apart and back together, as shown in FIG. 2(*b*).

What is needed is a rolling sheet door system that forms a continuous curtain of corrugated panels, which can be assembled and disassembled by rolling the corrugated panels together and apart without damage to the astatic or structural stability of the rolling sheet door.

SUMMARY

Embodiments of the invention provide an interlocking rolling sheet door system that forms a continuous curtain of corrugated panels, which can be assembled and disassembled by rolling the corrugated panels together and apart without damage to the astatic or structural stability of the rolling sheet door.

In accordance with at least one embodiment, there is provided an interlocking rolling sheet door, which includes at least one curtain panel. Each curtain panel includes a first curl on a lateral end and a second curl on an opposing lateral end. One of the first curl and the second curl is an interior curl portion, and the other of the first curl and the second curl is an exterior curl portion. The first curl of one curtain panel is configured to rotationally engage an inner portion of the second curl of an adjacent curtain panel, whereby the first curl rotationally engaging the second curl until a distal end of the first curl fouls out against an inner surface of the second curl. The first curl and the second curl are configured to rotationally engage one another to form an interlocking mechanism between adjacent curtain panels to form the interlocking rolling sheet door.

According to at least one embodiment, the interlocking mechanism is arranged on an exterior surface of the interlocking rolling sheet door.

According to at least one embodiment, when the distal end of the first curl fouls out against the inner surface of the second curl, a planar surface of the first curl is positioned parallel with a planar surface of the second curl.

According to at least one embodiment, the first curl includes a planar surface and a curved portion, and the second curl includes a planar surface, a curved portion, and a return portion extending from a distal end of the curved portion of the second curl.

According to at least one embodiment, the first curl of one curtain panel is configured to rotationally engage an inner portion of the second curl of an adjacent curtain panel in a counter-clockwise direction.

According to at least one embodiment, an inner surface of the return portion of the second curl is configured to foul out the first curl, thereby preventing adjacent curtain panels from hinging more than 180° in an opposite direction.

According to at least one embodiment, the first curl includes an inside leg extending from one distal end and a planar portion extending from another distal end, and the second curl includes an outside leg extending from one distal end, and a planar portion extending from another distal end, wherein the inside leg of the first curl is configured to be inserted into the inner portion of the second curl, when an angle between the planar portion of the first curl and the planar portion of the second curl is approximately 55°-75°.

In accordance with at least one embodiment, there is provided a method for assembling an interlocking rolling sheet door. The method includes rotationally engaging at least one curtain panel. Each curtain panel includes a first curl on a lateral end and a second curl on an opposing lateral end. One of the first curl and the second curl is an interior curl portion, and the other of the first curl and the second curl is an exterior curl portion. In accordance with at least one embodiment, the step of rotationally engaging the at least one panel includes rotationally engaging the first curl of one curtain panel with an inner portion of the second curl of an adjacent curtain panel. The first curl rotationally engages the second curl until a distal end of the first curl fouls out against an inner surface of the second curl. The first curl and the second curl are configured to rotationally engage one another to form an interlocking mechanism between adjacent curtain panels for assembling the at least one curtain panel of the interlocking rolling sheet door.

According to at least one embodiment, the step of rotationally engaging the first curl and the second curl includes forming the interlocking mechanism on an exterior surface of the interlocking rolling sheet door.

According to at least one embodiment, when the distal end of the first curl fouls out against the inner surface of the second curl, a planar surface of the first curl is positioned parallel with a planar surface of the second curl.

According to at least one embodiment, the first curl includes a planar surface and a curved portion, and the second curl includes a planar surface, a curved portion, and a return portion extending from a distal end of the curved portion of the second curl.

According to at least one embodiment, the first curl of one curtain panel is configured to rotationally engage an inner portion of the second curl of an adjacent curtain panel in a counter-clockwise direction.

According to at least one embodiment, an inner surface of the return portion of the second curl is configured to foul out the first curl, thereby preventing adjacent curtain panels from hinging more than 180° in an opposite direction.

According to at least one embodiment, the first curl includes an inside leg extending from one distal end and a planar portion extending from another distal end, and the second curl includes an outside leg extending from one distal end, and a planar portion extending from another distal end, wherein the inside leg of the first curl is configured to be inserted into the inner portion of the second curl, when an angle between the planar portion of the first curl and the planar portion of the second curl is approximately 55°-75°.

Various objects, advantages and features of the invention will become apparent from the following description of embodiments with reference to the accompanying drawings.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well.

FIG. 2(*b*) is a front view of the conventional rolling steel or slat door shown in FIG. 2(*a*), illustrating the lateral assembly of two adjacent curtain slats.

FIG. 2(*c*) is another side view of the conventional rolling steel or slat door, illustrating the full range of angular rotation required to wrap the door shown in FIGS. 2(*a*) and 2(*b*) around a barrel assembly without binding or separation.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Embodiments of the invention provide an interlocking rolling sheet door system that forms a continuous curtain of corrugated panels, which can be assembled and disassembled by rolling the corrugated panels together and apart without damage to the astatic or structural stability of the rolling sheet door. It would be contemplated by one of ordinary skill in the art of rolling sheet doors that the embodiments described herein could be used in other applications, such as roofing/wall panels, slat doors, storm shutters, sectional doors, truck bedcovers, as non-limiting examples.

Embodiments of the invention provide an interlocking rolling sheet door system that is characterized by the interlocking of curtain panels, which can be assembled and disassembled by easily rolling or folding out a curtain panel from its connection to an adjacent curtain panel. Embodiments of the invention eliminate the conventional "hem and seam" process used by many conventional rolling sheet doors. Embodiments of the invention also do not require lateral space adjacent to the rolling sheet door, and therefore the interlocking rolling sheet door can be assembled and disassembled more conveniently in a manufacturing facility and in the field. As a result, less equipment and manufacturing and repairs costs are necessary to manufacture and repair the interlocking rolling sheet door according to various embodiments of the invention.

Figure 1A:
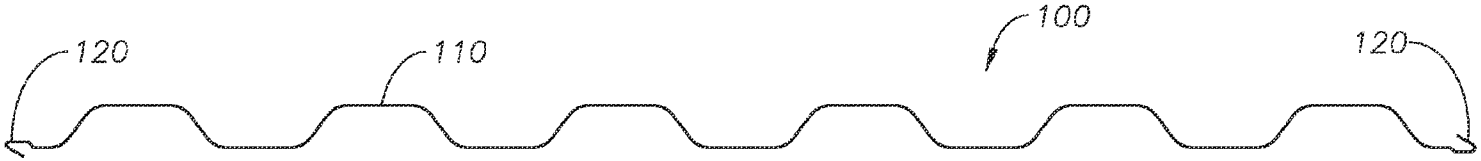
FIG. 1(a) (Prior Art)
FIGS. 1(*a*)-(*c*) are side views of a conventional rolling sheet door, including a seam formed to interlock two consecutive curtain panel hems to create a continuous door curtain.
Figure 1B:
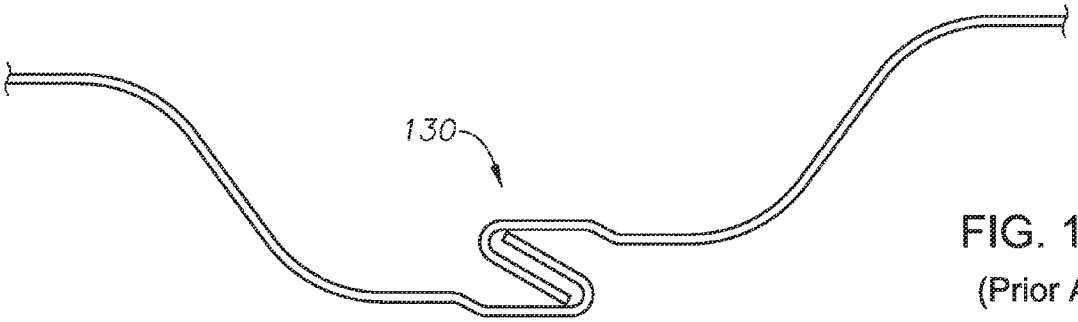
FIG. 1(b) (Prior Art)
Figure 1C:
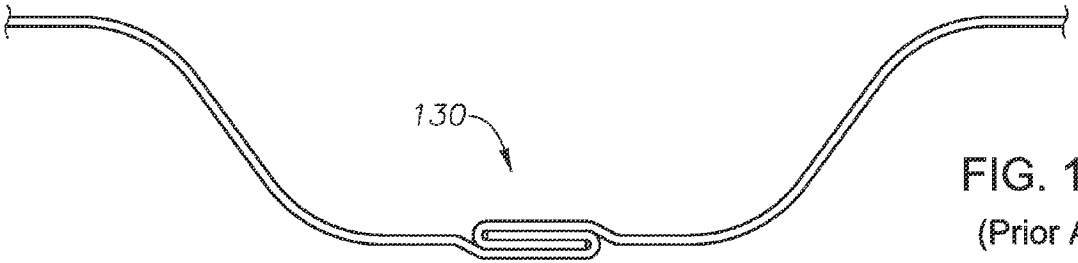
FIG. 1(c) (Prior Art)
Figure 2C:
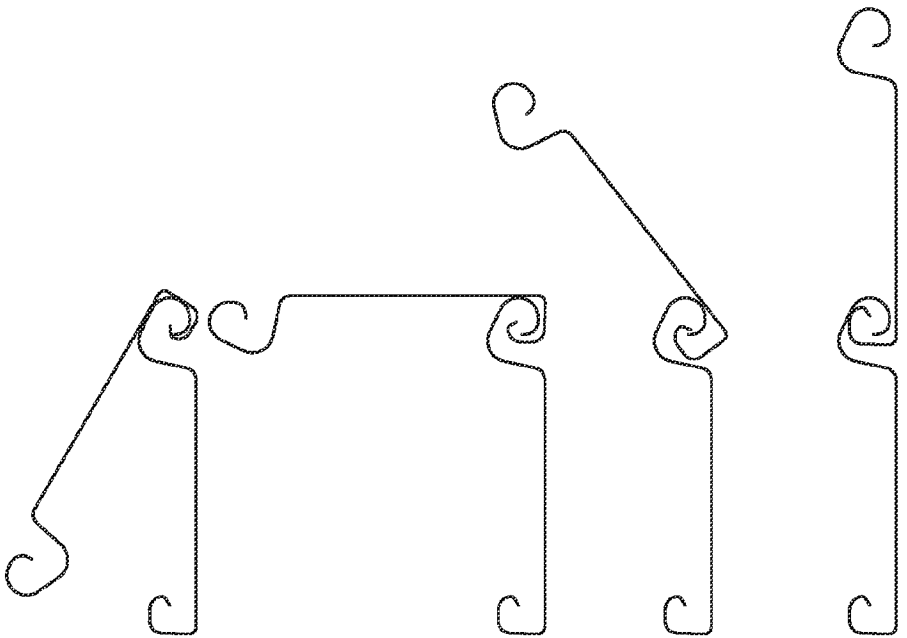
FIG. 2(c) (Prior Art)
FIG. 2(*a*) is a side view of a conventional rolling steel or slat door.
Figure 2A:
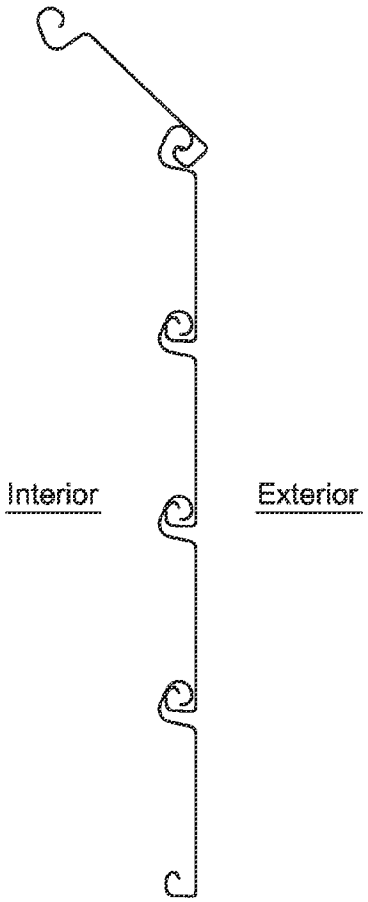
FIG. 2(a) (Prior Art)
Figure 2B:
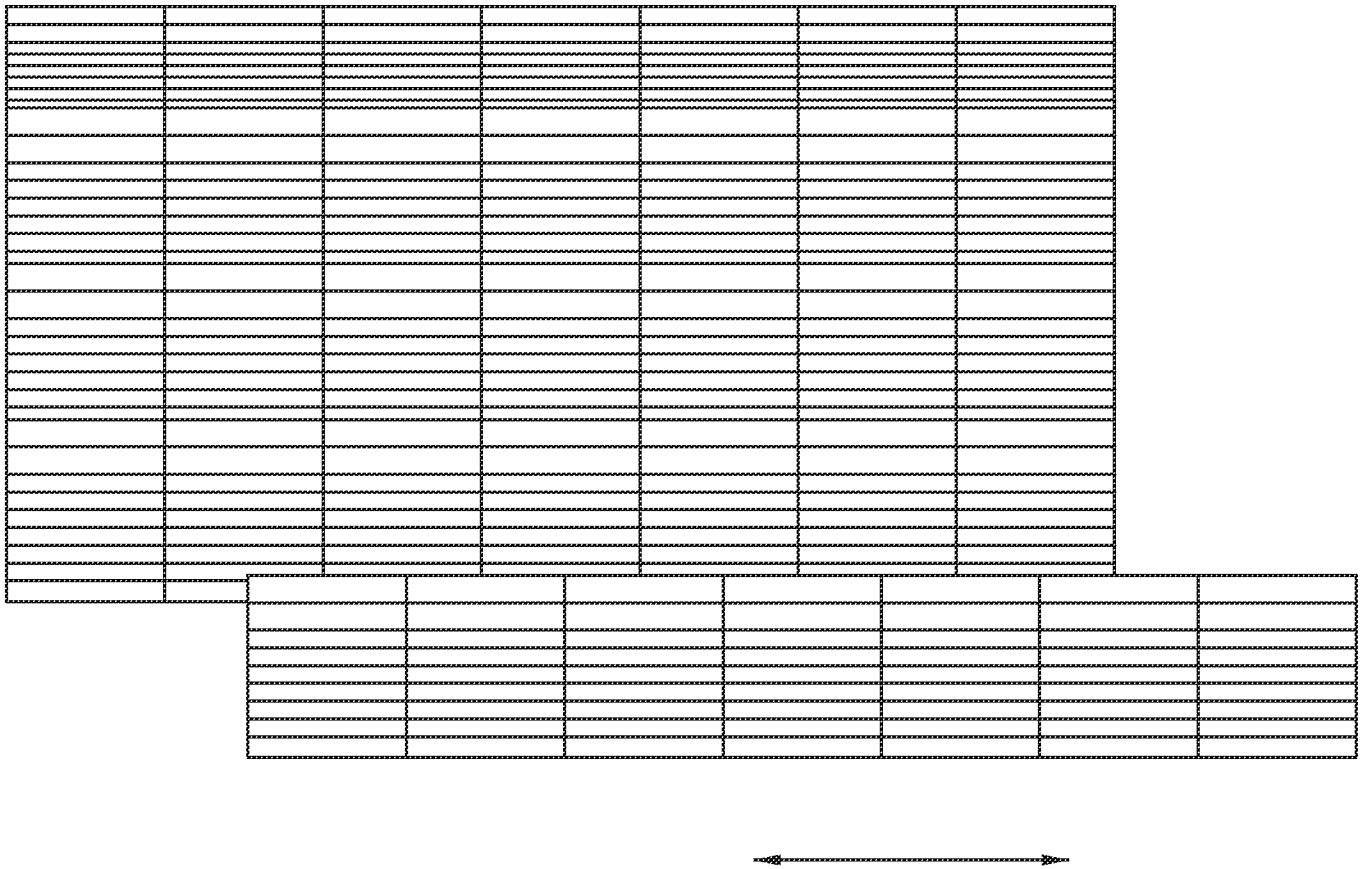
FIG. 2(b) (Prior Art)
Figure 3A:
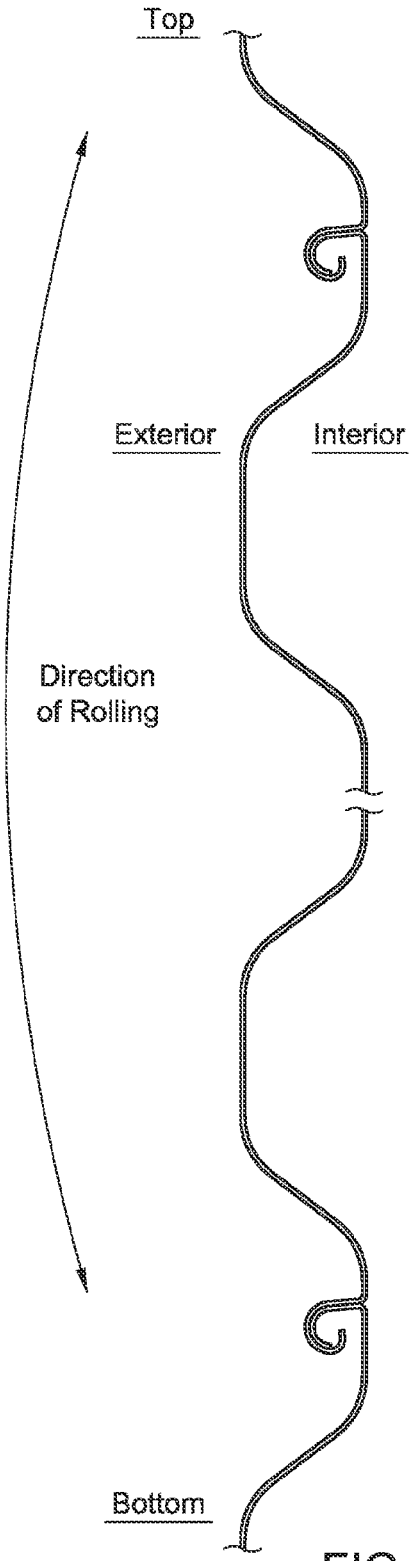
FIGS. 3(*a*) and 3(*b*) are a graphical comparison between an interlocking rolling sheet door, in accordance with an embodiment of the invention, and a conventional slat door, as shown in FIGS. 2(*a*), 2(*b*), and 2(*c*), respectively.
Figure 3B:
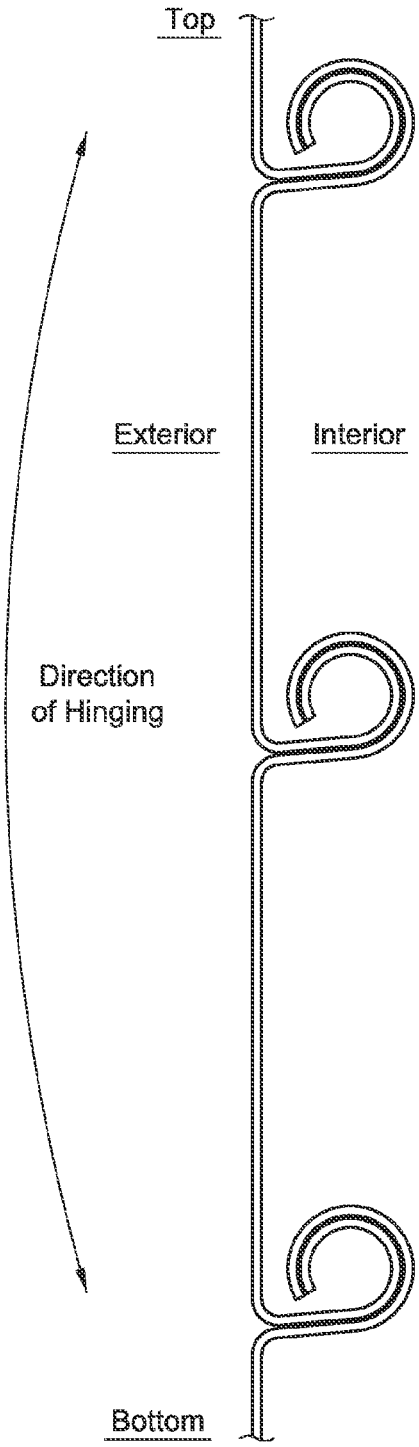
FIG. 3(b) (Prior Art)

FIGS. 3(*a*) and 3(*b*) are a graphical comparison between an interlocking rolling sheet door, in accordance with an embodiment of the invention, and a conventional steel or slat door, as shown in FIGS. 2(*a*), 2(*b*), and 2(*c*), respectively.

As shown in FIG. 3(*a*), the interlocking rolling sheet door, in accordance with an embodiment of the invention, includes a plurality of curtain panels connected to one another using an interlocking mechanism. The interlocking mechanism, which will be discussed in more detail below, includes a first curl being a male portion or inside curl engaging a second curl being a female portion or outside curl. The first curl and the second curl are configured to engage one another, so that the two curls foul out against each other, locking the two curls to one another, and therefore locking the two adjacent curtain panels to one another. As further shown in FIG. 3(*a*), the interlocking mechanism is arranged on an exterior side of the interlocking rolling sheet door. As can be seen from a comparison of FIGS. 3(*a*) and 3(*b*), the interlocking rolling sheet door, in accordance with an embodiment of the invention, is rolled in a manner that is opposite to a hinging direction of the conventional steel or slat door, as shown in FIGS. 2(*a*)-2(*c*). As noted above, the plurality of slats of the conventional rolling steel or slat door are connected to one another using a hinging mechanism positioned on an interior side of the slat door.

The configuration of the interlocking rolling sheet door, in accordance with an embodiment of the invention, being hinged in a direction opposite to the conventional steel or slat door prevents it from hinging or passing 180° in the opposite direction (i.e., the interlocking rolling sheet door, cannot be hinged or passed more than 180° in the direction that the conventional steel or slat door is hinged).

Figure 4:
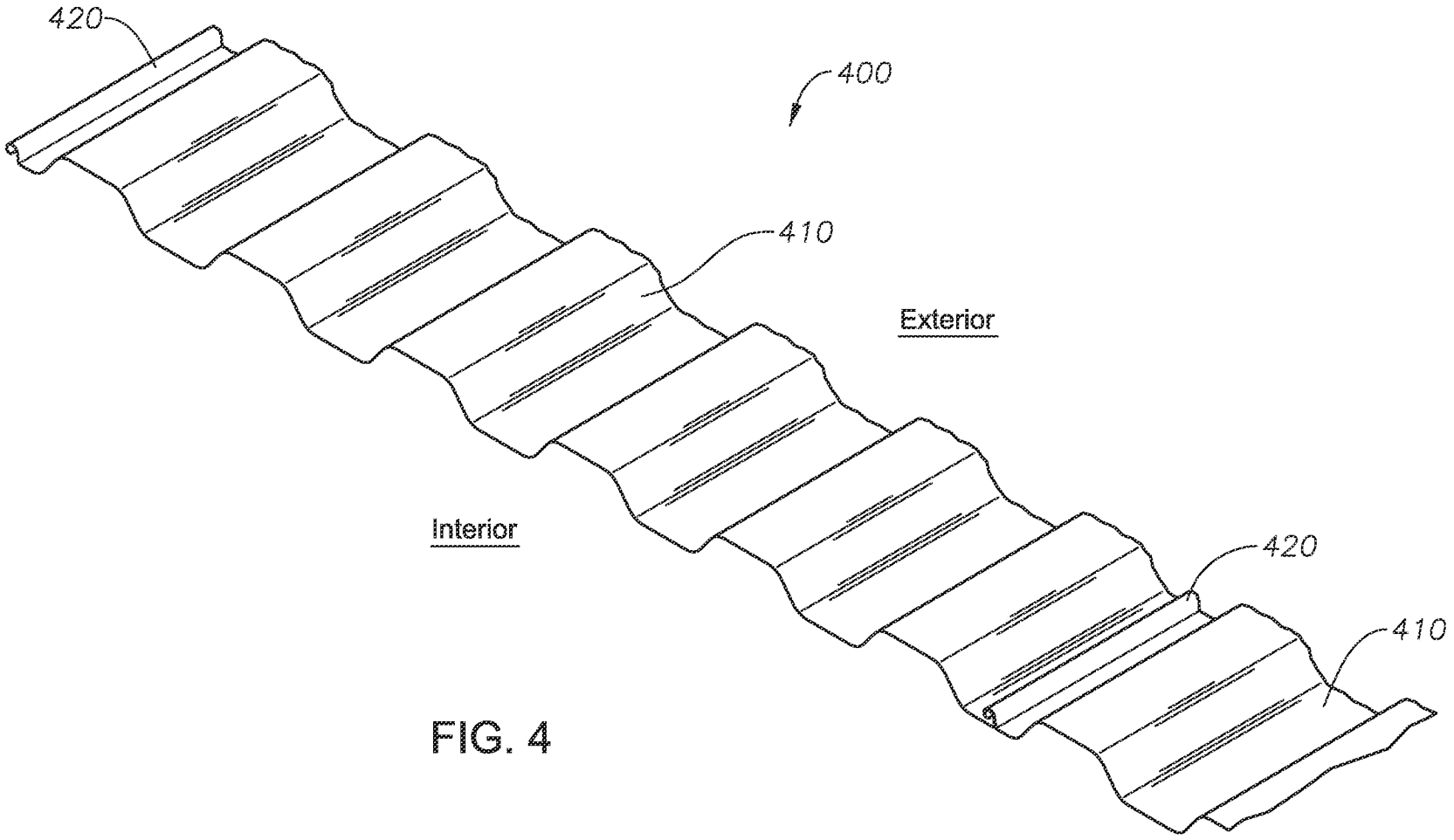
FIG. 4 is a perspective view of an interlocking rolling sheet door, in accordance with an embodiment of the invention.

FIG. 4 is a perspective view of an interlocking rolling sheet door, in accordance with an embodiment of the invention. As shown in FIG. 4, the interlocking rolling sheet door 400, in accordance with at least one embodiment, includes at least one curtain panel 410 and an interlocking mechanism 420, which will be described in more detail below with reference to FIGS. 5(*a*), 5(*b*), 6, 7(*a*), 7(*b*), and 7(*c*).

Figure 6:
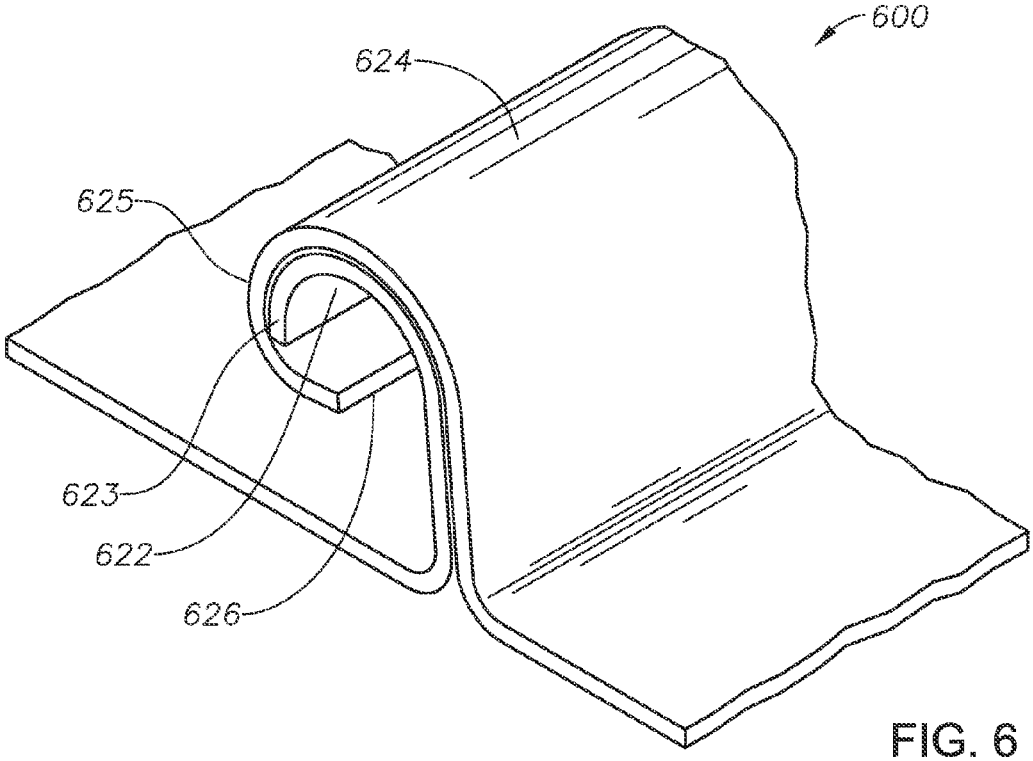
FIG. 6 is a detailed perspective view of the interlocking mechanism, as shown in FIGS. 4, 5(*a*) and 5(*b*), of the interlocking rolling sheet door, in accordance with an embodiment of the invention.
Figure 7A:
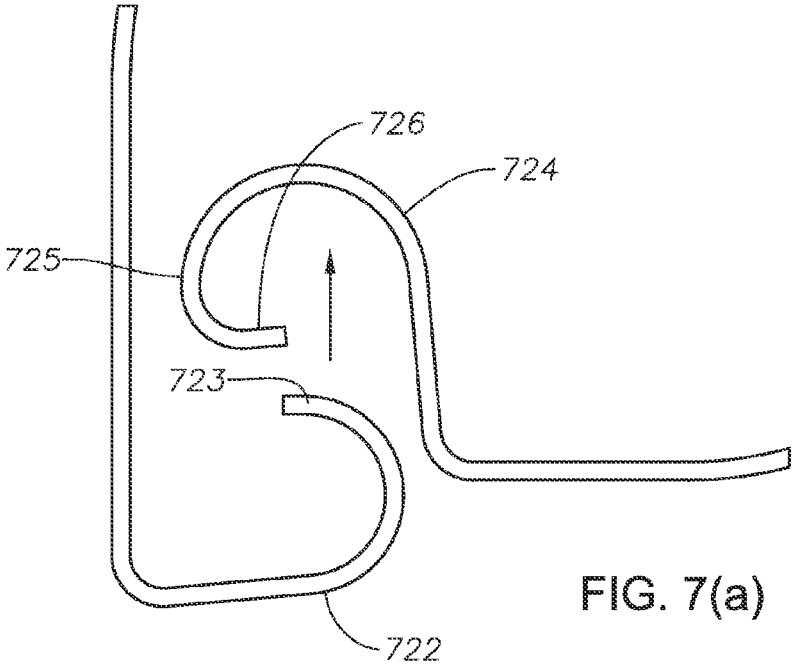
FIGS. 7(*a*), 7(*b*), and 7(*c*) are detailed perspectives of a process for engaging the male portion (inside curl) and the female portion (outside curl) of the interlocking mechanism, as shown in FIGS. 4, 5(*a*) 5(*b*), and 6, of the interlocking rolling sheet door, in accordance with an embodiment of the invention.
Figure 7B:
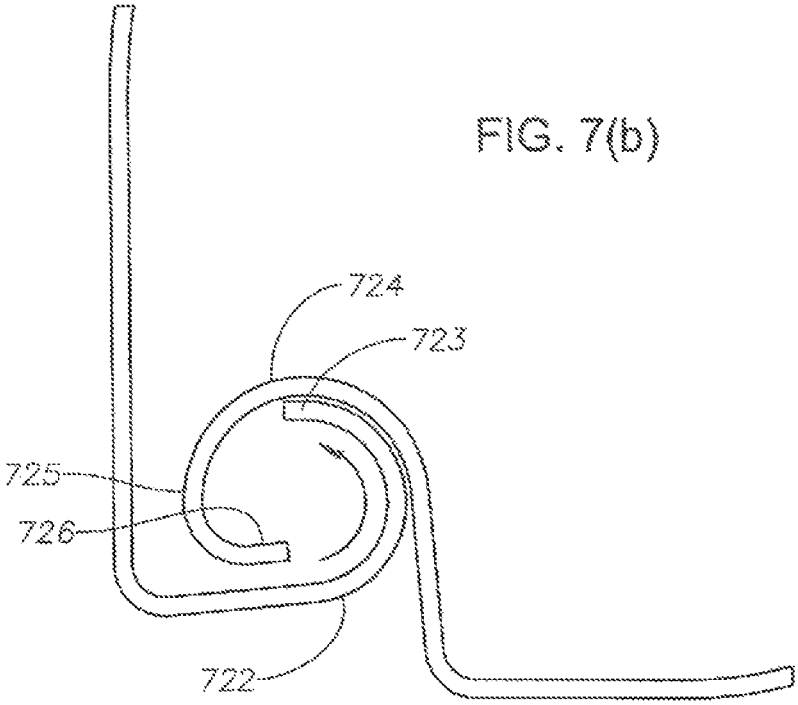
Figure 7C:
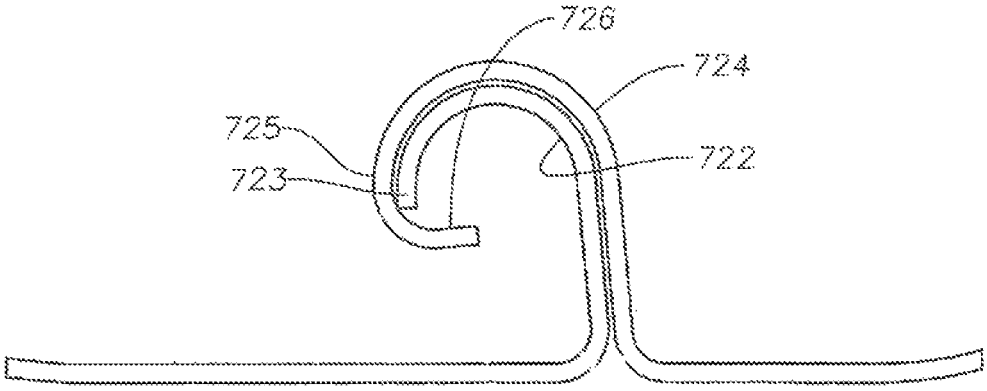

According to at least one embodiment of the invention, the interlocking rolling sheet door 400 includes flat surfaces that are parallel to each other where two adjacent curtain panels come together, thereby causing radiuses of a male portion and a female portion of the interlocking mechanism 420 to engage and foul out against one another, as shown in more detail in FIGS. 6, 7(*a*), 7(*b*), and 7(*c*).

Figures 5A, 5B:
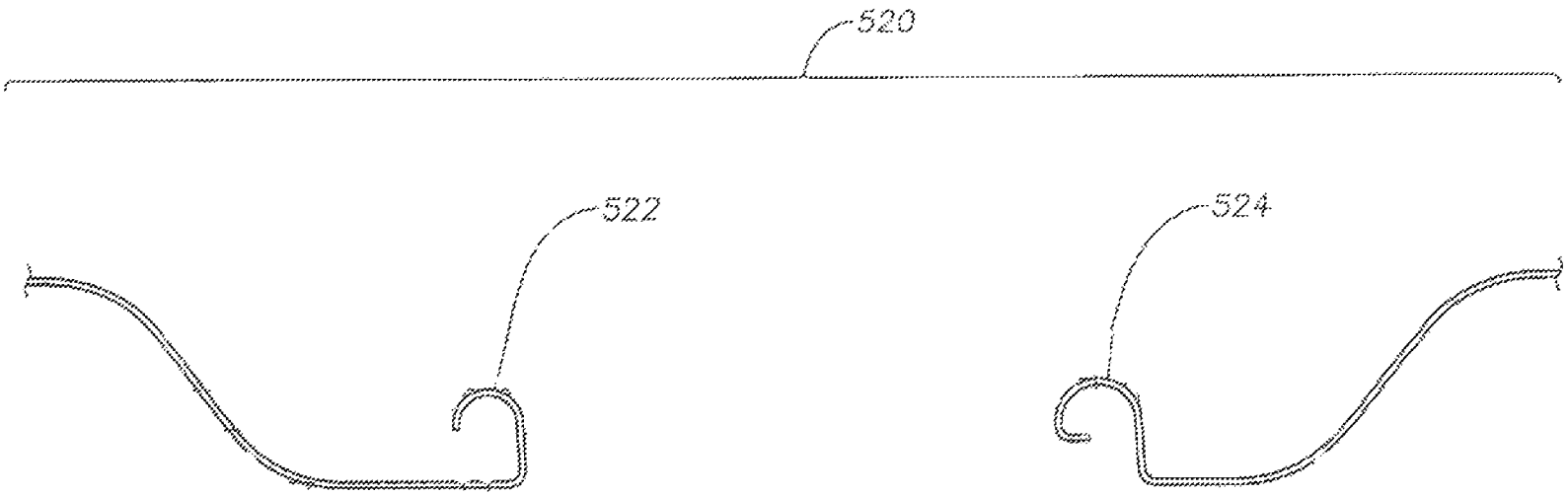
FIGS. 5(*a*) and 5(*b*) are perspective views of an interlocking mechanism of the interlocking rolling sheet door, as shown in FIG. 4, in accordance with an embodiment of the invention. In particular, FIG. 5(*a*) is a perspective view of the male portion (inside curl) of the interlocking mechanism, and FIG. 5(*b*) is a perspective view of the female portion (outside curl) of the interlocking mechanism, in accordance with an embodiment of the invention.

FIGS. 5(*a*) and 5(*b*) are perspective views of an interlocking mechanism of the interlocking rolling sheet door, as shown in FIG. 4, in accordance with an embodiment of the invention. In particular, FIG. 5(*a*) is a perspective view of the male portion (inside curl) of the interlocking mechanism, and FIG. 5(*b*) is a perspective view of the female portion (outside curl) of the interlocking mechanism, in accordance with an embodiment of the invention. As shown in FIGS. 5(*a*) and 5(*b*), the interlocking mechanism 520 includes a male portion 522 and a female portion 524. As shown in FIGS. 5(*a*) and 5(*b*), the interlocking mechanism 520 includes a slight angle, for example 95° from the horizontal, to allow for water to run off an exterior side of the door.

As further shown in FIGS. 5(*a*) and 5(*b*), the male portion 522 and the female portion 524 have configurations (i.e., a radius of curvature of the male portion 522 and the female portion 524, a height of an apex of the curvature of the male portion 522 and the female portion 524, and a length and a degree of curvature of the male portion 522 and the female portion 524, as non-limiting examples) that structurally complement one another, so that the male portion 522 engages an inner portion or cavity of the female portion 524, and, when rotationally engaged, allows the male portion 522 to foul out against the female portion 524.

FIG. 6 is a detailed perspective view of the interlocking mechanism, as shown in FIGS. 4, 5(*a*) and 5(*b*), of the interlocking rolling sheet door, in accordance with an embodiment of the invention.

Embodiments of the invention provide an interlocking rolling sheet door system 600 that is characterized by the interlocking of curtain panels that are rolled together, rather than laterally slid together, such as curtain panels used in conventional steel or slat doors, as discussed above. This is achieved by reducing the length of the inside leg (e.g., the male inside curl portion) and adding a small return to the outside leg (e.g., the female outside curl portion), as shown in FIG. 6. As shown in FIG. 6, the male portion 622 has an inside leg 623 that is reduced in length (in comparison to the female portion 624), while the female portion 624 includes an outside leg 625 having a return portion 626.

FIGS. 7(*a*), 7(*b*), and 7(*c*) are detailed perspectives of a process for engaging the male portion (inside curl) and the female portion (outside curl) of the interlocking mechanism, as shown in FIGS. 4, 5(*a*) 5(*b*), and 6, of the interlocking rolling sheet door, in accordance with an embodiment of the invention.

In particular, FIG. 7(*a*) illustrates a first step of engaging the male portion 722 (inside curl) and the female portion 724 (outside curl) of the interlocking mechanism, as shown in FIGS. 4, 5(*a*) and 5(*b*), of the interlocking rolling sheet door. As shown in FIG. 7(*a*), the male portion 722 includes an inside leg 723 extending from one distal end, and a planar portion extending from the other distal end. As further shown in FIG. 7(*a*), the female portion 724 includes an outside leg 725 extending from one distal end, and a planar portion extending from the other distal end. As further shown in FIG. 7(*a*), when the male portion 722 is about to engage the female portion 724, the inside leg 723 is able to be inserted into the inner portion or cavity of the female portion 724, when an angle between the planar portion of the male portion 722 and the planar portion of the female portion 724 is approximately 55°-75°.

FIG. 7(*b*) illustrates a second step of engaging the male portion 722 and the female portion 724. As shown in FIG. 7(*b*), the male portion 722 is rotated within the inner portion or cavity of the female portion 724 in a counter-clockwise direction until the inside leg 723 of the male portion 722 fouls out against an inner surface of the outside leg 725 of the female portion 724. As the male portion 722 rotates counter-clockwise in the inner portion or cavity of the female portion 724, the angle between the planar portion of the male portion 722 and the planar portion of the female portion 724 increases.

FIG. 7(*c*) illustrates the male portion 722 engaged and fouled out against the female portion 724. As shown in FIG. 7(*c*), the inside leg 723 of the male portion 722 fouls out against the inner surface of the outside leg 725 of the female portion 724, such that the return portion 726 extends past the end of the inside leg 723, preventing the male portion 722 from further rotating within the inner portion or cavity of the female portion 724, and therefore preventing adjacent curtain panels from hinging or passing 180° in the opposite direction, thereby locking adjacent curtain panels together in a secure manner. As further shown in FIG. 7(*c*), when the male portion 722 and the female portion 724 are fully engaged, adjacent curtain panels are substantially planar to one another.

As briefly discussed above, with respect to conventional steel or slat doors, when the male portion of the hinge is slid laterally into the female portion, the two portions, and therefore the two slats, are locked together, as shown in FIGS. 2(*a*), 2(*b*), 2(*c*), and 3(*b*). The only way to separate the male and female portions is by laterally sliding one slat apart from the other, which requires significant lateral space. The sliding of slats, while effective, is not efficient in production or in the field after installation.

The interlocking rolling sheet door, in accordance with various embodiments of the invention, is only similar in appearance to a conventional steel or slat door. The interlocking mechanism, according to various embodiments, of the interlocking rolling sheet door as described herein, is distinctly unique from the interlocking mechanism used to interlock two adjacent slats on a conventional steel or slat door. As shown in FIG. 3(*a*), the interlocking mechanism has been configured on the exterior side of the interlocking rolling sheet door, and inverted to prevent the door from hinging or passing 180° in the opposite direction, thereby locking adjacent curtain panels together in a secure manner.

Furthermore, the interlocking mechanism, according to various embodiments of the invention, is distinct from the interlocking mechanism of a conventional steel or slat door in that slats of a conventional steel or slat door are assembled typically using 2" or 3" slats that hinge as the conventional slat door rolls up. This is in accordance with ANSI/DASMA 203 Section 6, 6.1. The slats of a conventional slat door cannot be rolled together due to the design and dimensions of their hinge. In assembly of the conventional slat door, the individual slats have to be slid together from end to end (i.e., laterally slid together). They cannot be rolled together like the curtain panels according to various embodiments of the invention. If one were to assemble two slats of a conventional slat door and attempt to roll them together, the two slats would foul out by the opposite sides hitting each other.

For conventional steel or slat doors for a 12' wide doors in a 15' wide building, there is clearly insufficient lateral space to slide a 12' slat out to disengage it from an adjacent curtain panel, nor could one add a new slat for the same reason. In order to repair or maintenance the rolling slat door, the technician would have to remove the entire door from the drum and have it serviced outside of the building where sufficient space would be available to disassemble the slats. This would be time consuming, dangerous to the technician, and increase maintenance expenses.

The interlocking rolling sheet door, according to various embodiments of the invention, overcomes these challenges of conventional rolling sheet or slat doors. As generally discussed above, various embodiments of the invention provide an interlocking rolling sheet door including an interlocking mechanism arranged on an exterior side of the door and inverted to prevent the door from hinging or passing 180° in the opposite direction, thereby locking adjacent curtain panels together in a secure manner. The interlocking mechanism includes a first curl that engages a second curl, such that the radiuses of the male and female portions of the interlocking mechanism engage and foul out against one another. The interlocking mechanism allows for the assembly, repair, and/or replacement of curtain panels without requiring a seaming process or lateral space. Accordingly, the curtain panels, according to various embodiments of the invention, are connected in a manner, which allows the curtain panels, when connected, to curve around a drum of the door mechanism, rather than hinge.

Embodiments of the present invention may suitably comprise, consist or consist essentially of the elements disclosed and may be practiced in the absence of an element not disclosed. For example, it can be recognized by those skilled in the art that certain steps can be combined into a single step.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe the best method he or she knows for carrying out the invention.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

Ranges may be expressed herein as from about one particular value, and/or to about another particular value. When such a range is expressed, it is to be understood that another embodiment is from the one particular value and/or to the other particular value, along with all combinations within said range.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The invention claimed is:

1. An interlocking rolling sheet door, comprising:

a plurality of curtain panels, wherein each curtain panels comprises a lateral end and an opposing lateral end, the lateral end comprising a first curl portion and the opposing lateral end comprising a second curl portion, wherein the first curl portion comprises a first planar portion and a first continuous arcuate portion with a constant first radius extending to a distal end of the first curl portion, wherein the second curl portion comprises a second planar portion and a second continuous arcuate portion with a constant second radius larger than the constant first radius, the second curl portion further comprising a discontinuous return portion at a distal end of the second curl portion, wherein the first curl portion of each curtain panel is configured to rotationally engage an interior surface of the second curt portion of an adjacent curtain panel of the plurality of curtain panels, such that distal end of the first curl portion is configured to foul out against an interior surface of the discontinuous return portion of the second curl portion to thereby form an interlocking mechanism between two adjacent curtain panels of the plurality of curtain panels, wherein the interlocking mechanism is arranged on an exterior side of the interlocking rolling sheet door and configured to connect the plurality of curtain panels to form the interlocking rolling sheet door.

2. The interlocking rolling sheet door according to claim 1, wherein, when the distal end of the first curl portion fouls out against the interior surface of the discontinuous return portion of the second curl portion, a planar surface of the first curl portion is positioned coplanar with a planar surface of the second curl portion.

3. The interlocking rolling sheet door according to claim 1, wherein the interior surface of the discontinuous return portion of the second curl portion is configured to foul out against the distal end of the first curl portion, thereby preventing the two adjacent curtain panels from hinging past a position in which the two adjacent curtain panels are coplanar.

* * * * *